US009247799B1

(12) United States Patent
Cernasov

(10) Patent No.: US 9,247,799 B1
(45) Date of Patent: Feb. 2, 2016

(54) PRODUCT DISPENSER WITH INERTIAL VALVE

(71) Applicant: Wormser Corporation, Englewood, NJ (US)

(72) Inventor: Andrei D. Cernasov, Ringwood, NJ (US)

(73) Assignee: Wormser Corporation, Englewood, NJ (US)

( * ) Notice: Subject to any disclaimer, the term of this patent is extended or adjusted under 35 U.S.C. 154(b) by 499 days.

(21) Appl. No.: 13/651,054

(22) Filed: Oct. 12, 2012

Related U.S. Application Data

(60) Provisional application No. 61/547,206, filed on Oct. 14, 2011.

(51) Int. Cl.
*A45D 33/16* (2006.01)

(52) U.S. Cl.
CPC ..... *A45D 33/16* (2013.01); *A45D 2200/05* (2013.01)

(58) Field of Classification Search
CPC .... A45D 33/02; A45D 33/16; A45D 2200/05
USPC ..... 141/192, 247, 319–322, 363–366; 222/142.1, 196.1–196.5
See application file for complete search history.

(56) References Cited

U.S. PATENT DOCUMENTS

| | | | | |
|---|---|---|---|---|
| 2,706,580 | A * | 4/1955 | Keith | 222/501 |
| 4,906,120 | A | 3/1990 | Sekiguchi et al. | |
| 4,974,981 | A | 12/1990 | Bennett | |
| 5,542,579 | A | 8/1996 | Robbins, III | |
| 6,159,188 | A * | 12/2000 | Laibovitz et al. | 604/294 |
| 6,467,656 | B1 * | 10/2002 | Nagayanagi | 222/456 |
| 7,273,059 | B2 * | 9/2007 | Lee | 132/299 |
| 8,016,508 | B2 | 9/2011 | Byun | |
| 8,181,828 | B2 * | 5/2012 | Deans | 222/282 |
| 8,210,187 | B1 | 7/2012 | Zhang | |
| 8,226,313 | B2 | 7/2012 | Brendel et al. | |
| 8,245,886 | B2 * | 8/2012 | Deans | 222/322 |
| 8,336,563 | B2 | 12/2012 | Guenther et al. | |
| 8,915,398 | B2 * | 12/2014 | Deans | 222/1 |
| 2006/0201528 | A1 * | 9/2006 | Lee | 132/299 |
| 2010/0096410 | A1 * | 4/2010 | Deans | 222/182 |
| 2010/0096411 | A1 * | 4/2010 | Deans | 222/182 |
| 2010/0236572 | A1 * | 9/2010 | Guenther et al. | 132/299 |
| 2012/0241468 | A1 * | 9/2012 | Deans | 222/1 |

* cited by examiner

*Primary Examiner* — Nicolas A Arnett
(74) *Attorney, Agent, or Firm* — Middleton Reutlinger

(57) ABSTRACT

Embodiments of a product dispenser are taught which utilize an inertial valve to open the dispenser upon acceleration of the dispenser. The product dispenser includes an enclosure defined by at least one sidewall and a valve support plate. At least one inertial valve is located on the valve support plate to dispense material or product through the at least one valve.

17 Claims, 10 Drawing Sheets

PRODUCT DISPENSER WITH INERTIAL VALVE

STATEMENT REGARDING FEDERALLY SPONSORED RESEARCH

None.

REFERENCE TO SEQUENTIAL LISTING, ETC.

None.

CLAIM TO PRIORITY

This non-provisional application claims priority and benefit under 35 U.S.C. §119(e) to the following U.S. Provisional App. No. 61/547,206, filed on Oct. 14, 2011.

BACKGROUND

1. Field of the Invention

Present embodiments are related to a dispenser which may or may not include a product container or enclosure. More specifically, present embodiments are related to a dispenser which has an inertial valve for dispensing a material.

2. Description of the Related Art

Product dispensing devices include enclosures that dispense either powder or liquid. Some of the most successful cosmetic products sold in recent years belong to the "loose powders" category which spill easily and the quantity of powder passing through a standard enclosure, using a sifter plate, is hard to control. (See FIGS. 1*a* and 1*b*.)

So if, by mistake, a larger amount of loose powder than needed is released from a container it will invariably inconvenience the customer either by spilling on their clothes, in their bags or on the floor. Accidents with liquid dispensers are invariably more inconvenient.

In order to control the flow some designs use a sifter cover plate which covers the sifter holes when the powder is not being accessed (FIG. 2). To utilize these devices, a user rotates the cover plate so that the cover plate holes align with the holes in the sifter plate. Then the powder is allowed to flow until the desired amount passes through. Finally the user rotates the sifter cover plate back into its passive position inhibiting flow, of powder for example, until use is desired again.

It would be desirable to provide a structure which dispenses a desirable amount of a material contained in the dispenser. It would be further desirable to provide a feature which may be capable of allowing any excess material to be deposited back into the dispenser container.

SUMMARY

A product dispenser comprises an enclosure having a valve support plate enclosing at least one sidewall, the valve support plate having at least one output aperture, an inertial valve connected to the valve support plate, the inertial valve having a head sealingly engaging the at least one output aperture, the head disengaging the at least one aperture during abrupt acceleration. The product dispenser further comprising a spring extending to the valve support plate. The product dispenser wherein the spring extends from a tensioner.

A product dispenser comprises a first dispenser portion for containing an undispensed powder having at least one sidewall, one bottom wall and a valve support plate containing at least one first dispensing aperture and at least one second dispensing aperture, a top which is positionable over the first dispenser portion, the top defining a container for housing dispensed powder passed through the valve support plate, the at least one first dispensing aperture having a first valve which is biased in a first open position, the at least one second dispensing aperture having a second valve which is biased in a second closed position, wherein accelerating the dispenser causes opening of the second valve and closing of the first valve to dispense the undispensed powder into the top. The product dispenser wherein the valves are spring biased. The product dispenser wherein the second valve inhibits free flow of the undispensed powder. The product dispenser wherein the at least one second valve is two valves. The product dispenser wherein the valve support plate extends between the at least one sidewall. The product dispenser wherein the valve support plate is circular in shape. The product dispenser wherein the valve support plate is a non-circular geometric shape. The product dispenser wherein the valve support plate is flat. The product dispenser wherein the valve support plate has a low point and a high point. The product dispenser wherein the valve support plate is curvilinear. The product dispenser wherein the first valve being openable to return excess powder to the container. The product dispenser wherein the second valve meters flow of the undispensed powder into the top. The product dispenser wherein the top includes an applicator. The product dispenser wherein the inertial valve has a head, a tensioner and a neck extending there between. The product dispenser wherein the valve head engages a hole in said valve support plate. The product dispenser wherein the heads are joined by a spring. The product dispenser wherein the spring is an elastic body.

A product dispenser comprises a top, an enclosure including a cover plate, the enclosure being connectable to the top, a plurality of flow apertures in the cover plate, an inertial valve engaging the flow apertures to selectively open upon application of acceleration, the inertial valve being biased against the cover plate to a normally closed position and flexing to move to an open position. The product dispenser wherein the inertial valve includes an input valve and an output valve. The product dispenser wherein the cover plate has a depression.

BRIEF DESCRIPTION OF THE DRAWINGS

In order that the embodiments may be better understood, embodiments of the product dispensing enclosure with inertial valve will now be described by way of examples. These embodiments are not to limit the scope of the claims as other embodiments of the product dispenser with inertial valve will become apparent to one having ordinary skill in the art upon reading the instant description. Non-limiting examples of the present embodiments are shown in figures wherein:

DETAILED DESCRIPTION

Figure 1A:
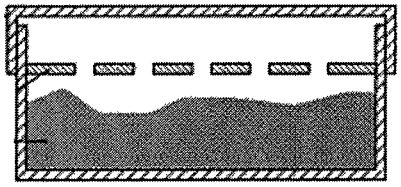
FIGS. 1*a* and 1*b* are side sectional views of one embodiment of a prior art dispenser
Figure 1B:
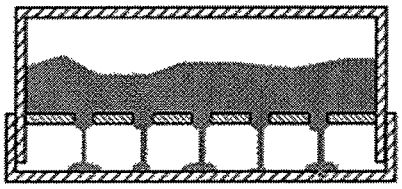
Figure 2:
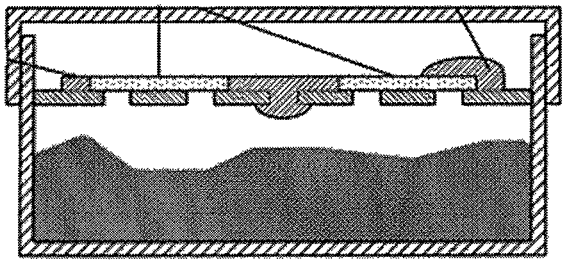
FIG. 2 is side sectional view of an alternate embodiment of a prior art dispenser which a rotatable cover plate for a sifter.

It is to be understood that the product dispenser with an inertial valve is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numeral indicate like elements throughout several views, there are shown in FIGS. 3 through 11 various embodiments of a dispenser which utilizes various types of inertial valves to retain a material or product in one position, but which release a preselected amount of product upon activation of the inertial valves.

Figures 3A, 3B:
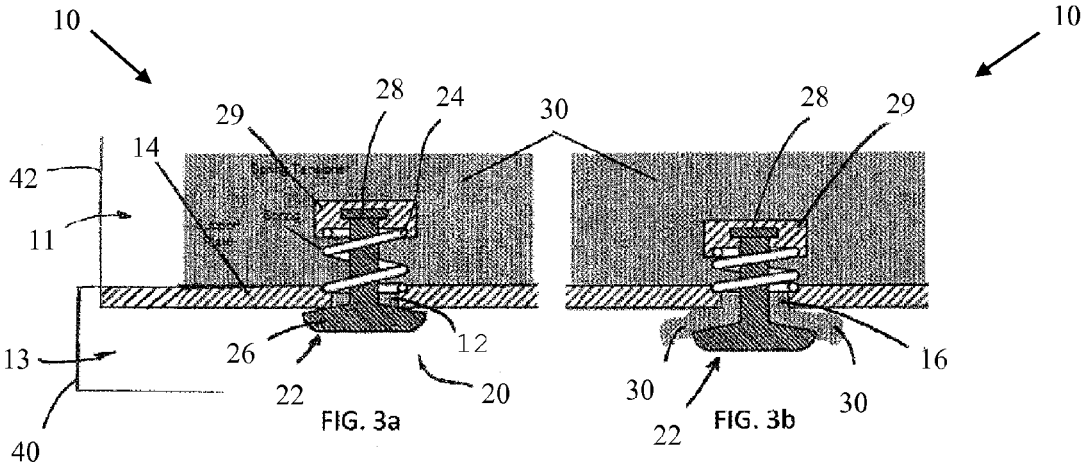
FIG. 3*a* is side section view of a first embodiment of a dispenser with an inertial valve in a closed position.
FIG. 3*b* is a side section view of the embodiment of FIG. 3*a* with the inertial valve in an open position.

Referring initially to FIG. 3*a*, a side view of a side view of a dispenser 10 is shown with an inertial valve 20 in a closed position. The dispenser 10 includes an upper container 11 wherein undispensed product is held and a lower container 13 wherein dispensed product is contained. The upper container 11, referred to as upper only because the dispenser 10 is shown in an inverted position, is formed by an enclosure 42 have at least one sidewall and a container bottom (not shown). The lower container 13, again shown in an inverted orientation, is defined by a top cover 40 which engages the enclosure 42. The engagement may be snap fit or threaded, for example. In one embodiment of the dispenser 10, for example a powder dispenser, the sifter or valve support plate 14 is provided wherein at least one inertial valve 20, optimized for powder flow control, is disposed. An inertial valve is a valve that actuates (allows flow or blocks flow) in the presence of acceleration. One exemplary inertial valve 20 is shown in FIGS. 3*a* and 3*b*. The inertial valve 20 includes a mass 22 which is biased in one direction by a biasing force, for example provided by spring 24. The mass 22 has a head 26 and a neck 28 which passes through aperture 16. At one end of the mass 22 is a tensioner 29 which engages spring 24 and against which the spring 24 applies the biasing force to retain the head 26 against the sifter plate 14. The mass 22 engages the aperture 16 to inhibit flow in the absence of acceleration.

The mass 22 is positioned through the dispenser sifter or valve plate 14. Specifically the mass 22 passes through an aperture 16 in the sifter plate 14. One or more apertures 16 may be found in a sifter plate 14 of a dispenser 10. In the embodiment of FIG. 3*a*, at rest (no acceleration), the spring 24 applies sufficient pressure on the inertial mass 22 (which in this case doubles as a plug) to keep the hole 16 covered and not allow the product 30, generally represented by stippling, to flow from the upper chamber to the lower one. The spring remains fully extended.

In the embodiment of FIG. 3*b*, a side section view is depicted wherein the inertial valve 20 is shown in an open position. The valve 20 is opened in the presence of an upward acceleration or opposite the spring force. Specifically, as the inertial mass 22 exerts an additional inertial force on the spring 24, the acceleration compresses the spring 24 between the tensioner 29 and sifter plate 14. This opens the hole 16 in the support plate 14 and allows the product 30 to temporarily flow through the sifter plate 14 or into the lower chamber or container 13.

Figure 4:
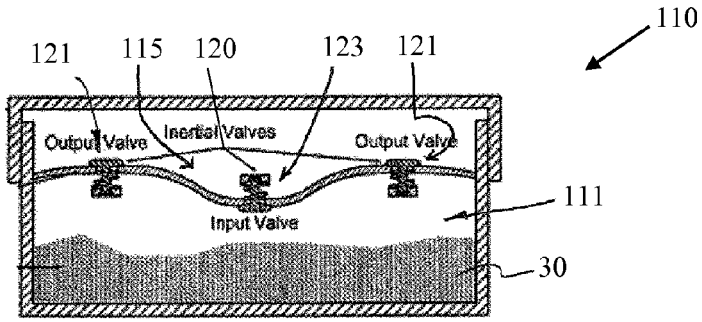
FIG. 4 is a side section view of an alternate embodiment of the dispenser with inertial dispenser valve.

FIG. 4 depicts an alternate embodiment of a product dispensing enclosure 110 with at least two inertial valves 120. More specifically, the exemplary embodiment includes three inertial valves. The valves 120 include two output valves 121 for dispensing product and one input valve 123 for returning unused product 30 to the product chamber 111. Although the embodiment of FIG. 4 depicts multiple inertial valves 120, other embodiments, not shown, may comprise various combinations of output and input valves, including for example, one or more output valves 121 and no input valves, or one or more output valves and multiple input valves 123.

The sifter plate or inertial valve support plate 114 separates the enclosure 110 into two volumes, an undispensed product chamber 111 and a dispensed product chamber 113. The chamber 111 stores the bulk of the product 30 which is undispensed. The dispensed product chamber 113 retains small amounts of product 30 which pass through the valves 121 for immediate use. The plate 114 has a number of embedded inertial valves, collectively valves 120, at least one allowing, when exposed to acceleration, flow outward from the product chamber 111 into the use chamber 113 (output valves 121), and at least one allowing flow in the opposite direction, from the use chamber 113 into the product chamber 111 (input valves 123). The input valve 123 is biased oppositely of the output valve 121 so that opposite accelerations are utilized to open the two types of valves.

As also shown in the figure, the sifter plate 114 may be curvilinear. In this embodiment, the plate 114 has a low elevation wherein the unused powder 30 in the chamber 113 may be utilized. This allows collection of the unused product 30 in this low area or depression 115. The input valve 123 is located in the valley area so that the product located in this area passes through the input valve 123 when the appropriate acceleration opens the input valve.

Figure 5A:
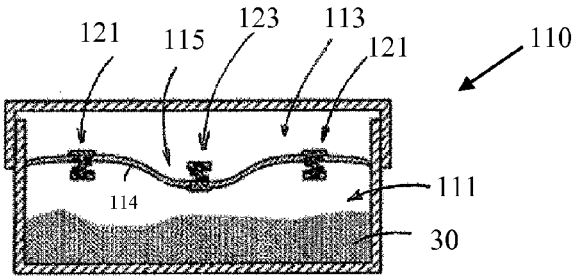
FIG. 5*a*-5*g* are multiple side section views of the dispenser of FIG. 4 during operation.

FIGS. 5*a*-*g* depict use of the product dispensing enclosure 110 with inertial valve to dispense powder from the enclosure. Referring to FIG. 5*a*, the when the enclosure 110 is not in used and is in storage, for example in a purse, or any other place, all powder is confined to the product chamber 111. This is insured by the fact that all the inertial valves 121,123 will remain closed as long as the enclosure is not subjected to high accelerations.

Figure 5B:
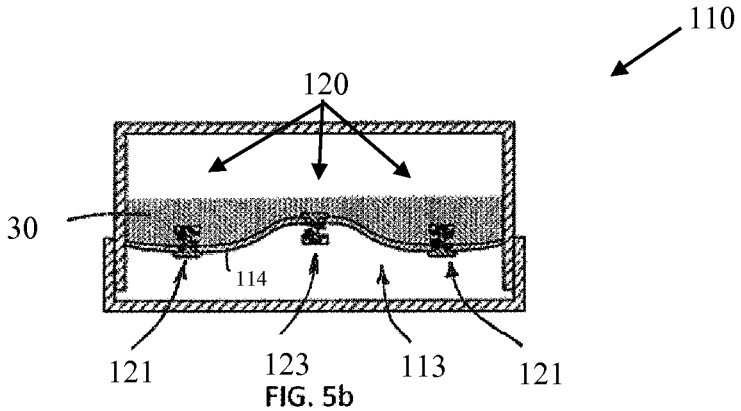

Referring now to FIG. 5*b* wherein the enclosure 110 is inverted. The biased closed position of the valves, collectively, 120 retains the product 30 within the upper (in the inverted orientation) enclosure 111. This holds true even when the enclosure is held upside down.

Figure 5C:
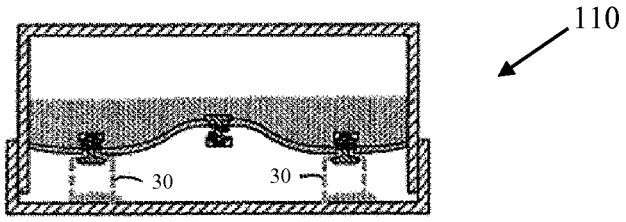

Referring now to FIG. 5*c*, the enclosure 110 is still in an inverted position. To use the powder 30, the powder must be first moved from the chamber 113. The enclosure is accelerated upward rapidly causing the springs of valve 121 to be overcome. This could alternatively happen by a rapid movement downward, with a sudden stop so that inertia continues to move the inertial mass 22 downward, opening the valve. For example, the enclosure 110 may be tapped on a hard surface, or shaken vertically with sufficient force to open the valve 121 (by providing shock deceleration).

In at least one embodiment, the inertial valves 120 are unidirectional, opening in one direction only. Therefore, upside down tapping will only open the output valves 121 while the input valve 123 remains closed. The above described acceleration will not cause opening of the input valve 123 because the valve 123 is oppositely biased to preclude opening in the same direction that allows opening of the valves 121.

Figure 5D:
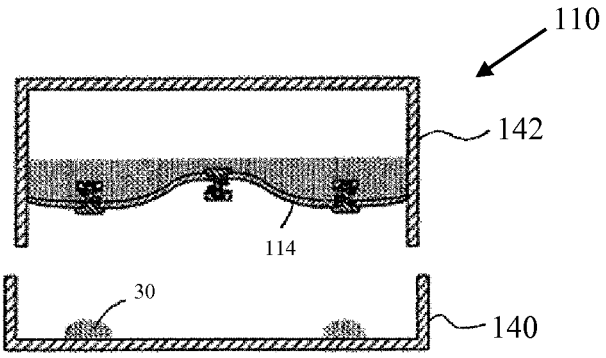

Referring now to FIG. 5*d*, the dispenser 110 is shown in an inverted position. The dispenser 110 has a top 140, which is below the enclosure xx in this embodiment. The top 140 defines the use chamber 113 and is removable from the enclosure 142 so as to access the dispensed product 30. With the top 140 removed, a user may then dip a brush or applicator into the product.

Figure 5E:
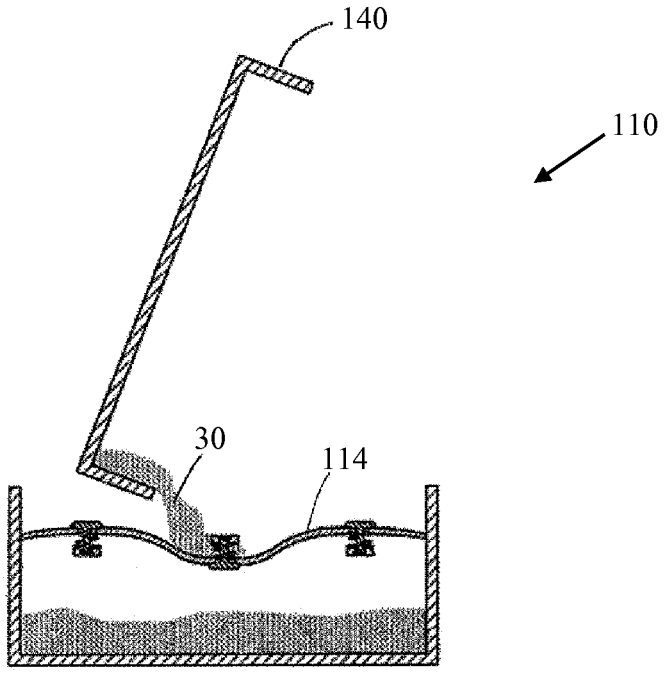
Figure 5F:
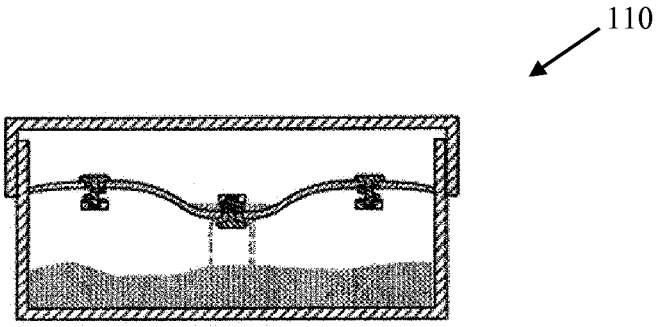
Figure 5G:
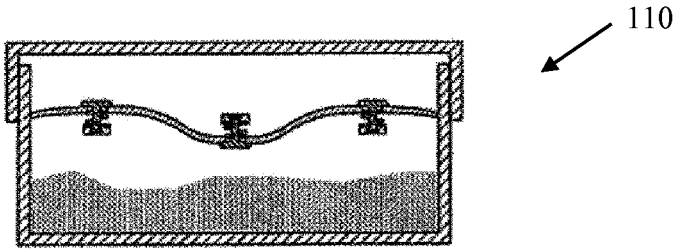

With reference now to FIG. 5*e*, often a certain amount of loose product 30, for example powder, will remain unused and in the top. In at least one embodiment, any surplus powder is placed on top of the inertial valve support plate 114. The plate 114 has a depression or valley wherein the product 30 collects adjacent to the input valve 123. Upon tapping the dispenser 110, the input valve 123 will open allowing product 30 to transfer back into the chamber 111 as shown in FIG. 5*f*. The valve 123 will then return to normally closed position after the acceleration and as shown in FIG. 5*g*.

Figure 6A:
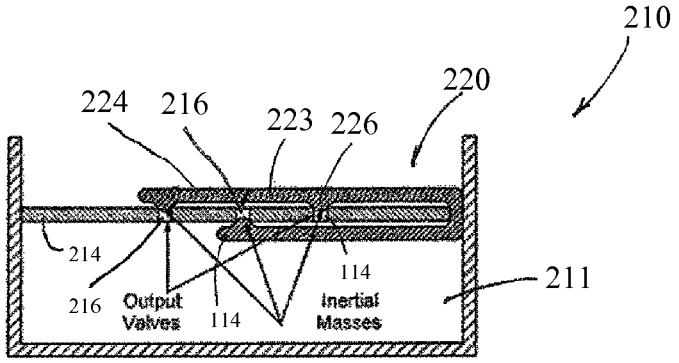
FIG. 6*a* is an alternate embodiment of an inertial valve.
Figure 6B:
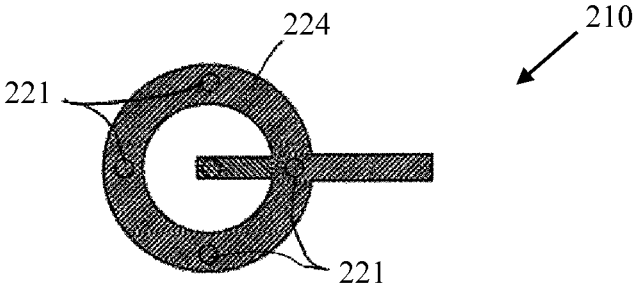
FIG. 6*b* is a top view of the spring used in FIG. 6*a*.

Referring now to FIGS. 6*a* and 6*b*, alternate valve designs are depicted. With reference first to FIG. 6*a*, a side section view of a dispenser 210 is shown with the top removed. This embodiment operates so that inertial valves are formed using a single spring studded with masses that are aligned with an equal number of holes formed in an inertial valve plate. Each hole and mass pair forms an inertial valve. The valve plate 214 extends across the dispenser 210 and has at least one aperture 216 therein. A valve 220 is formed by each of the apertures 216 and an elastic spring arm 224 having corresponding heads 226 which engage the apertures 216. As in the previous embodiments, the spring 224 flexes upon acceleration causing the heads 226 of output valves to open in a first direction. The head 226 of an input valve 223 opens in response to acceleration in a second direction. In order to accomplish the spring action in both directions (output and input), a lower spring arm is utilized to position the head 226 on the input valve 223 aperture 216 to define input valve 223.

With reference to FIG. 6*b*, the spring 224 is removed from the dispenser 210. The spring arm 224 is circular in shape and includes portions for output valves 221. The portion for input valve 223 is disposed centrally within the circular spring arm portion 224. Various alternative shapes may be utilized.

In operation, if the applied shock acceleration is upwards the input valve 223 will open. If the shock acceleration is downwards the output valves 221 will open. The flow of powder in either direction, to or from the product chamber 211 to the use Chamber, is controlled by a tap action.

Figure 7A:
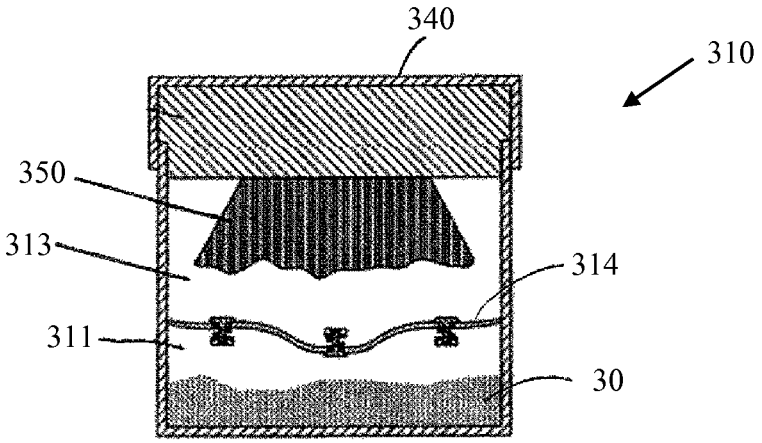
FIG. 7*a*-7*c* is a further alternative embodiment with a dispenser having an applicator.
Figure 7B:
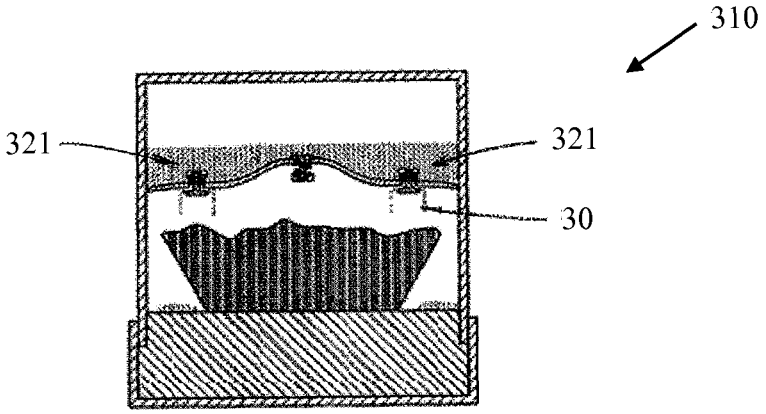
Figure 7C:
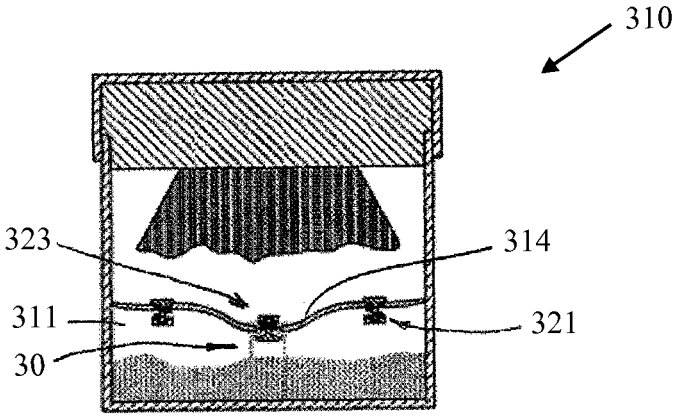

Referring now to FIGS. 7*a*-7*c*, in this embodiment, the dispenser 310 is shown including an applicator 350, such as a brush, integrated in the top 340. The applicator 350 receives product 30 according to this embodiment when the dispenser 310 is turned upside down and tapped onto a hard surface to provide the acceleration. The applicator 350 may be fixed or may be removable from the top 340. As shown in FIG. 7*a*, the dispenser 310 is in a normal upright position with the applicator 350 extending down toward the sifter or valve plate 314. Again, in this embodiment, the term plate is not limited to a planar design as the plate 314 has a depression for collection of product 30 as previously discussed.

With reference now to FIG. 7*b*, the dispenser 310 is inverted and accelerated as some product 30 is shown moving through the output valves 321. The product 30 is transferred through the output inertial valves 20 directly onto the applicator 350. Similarly, and with reference to FIG. 7*c*, the unused product 30 is returned to the product chamber 311 through an input valve 323 by way of an opposite acceleration. For example, the product 30 move from the depressed area of the plate 314 to the product chamber 311 by turning the dispenser 310 right side up and tapping it.

Referring now to FIG. 8*a* sectioned perspective view is shown of an alternate embodiment. The dispenser 410 includes a top 440 which is disposed over a product container or enclosure 442. The top 440 may be snap fit or threadably connected to the enclosure 442. The dispenser is shown in an upright position so that the product (not shown) is located in the enclosure 442. The enclosure includes a valve plate 414 extending across the enclosure 442. The plate 414 is shown at the periphery of the enclosure 442 but is removed partially to depict the inertial valve 420. The inertial valve 420 is circular in shape and corresponds to the dispenser shape but may correspond to any dispenser shape or may differ from the dispenser shape. The inertial valve 420 has an inertial mass 422 including a head 426 and a neck 428. The neck 428 passes through the plate 414 and the head 426 is disposed on a side of the plate 414 toward which product flow is desired. The masses 420 are connected by a valve ring or tensioner 429. A plurality of springs 424 extend from the tensioner 429 to a lower surface of the plate 414. When the springs 424 flex, the inertial mass 420 can move vertically so the neck 428 moves through the plate 414 and the head 426 moves away from the plate 414. In an inverted orientation, this allows product to pass through the cover plate apertures. The flexing of the spring 424 is achieved through the various forms of acceleration described previously such as tapping on a hard surface or shaking in two opposite directions.

Figure 8:
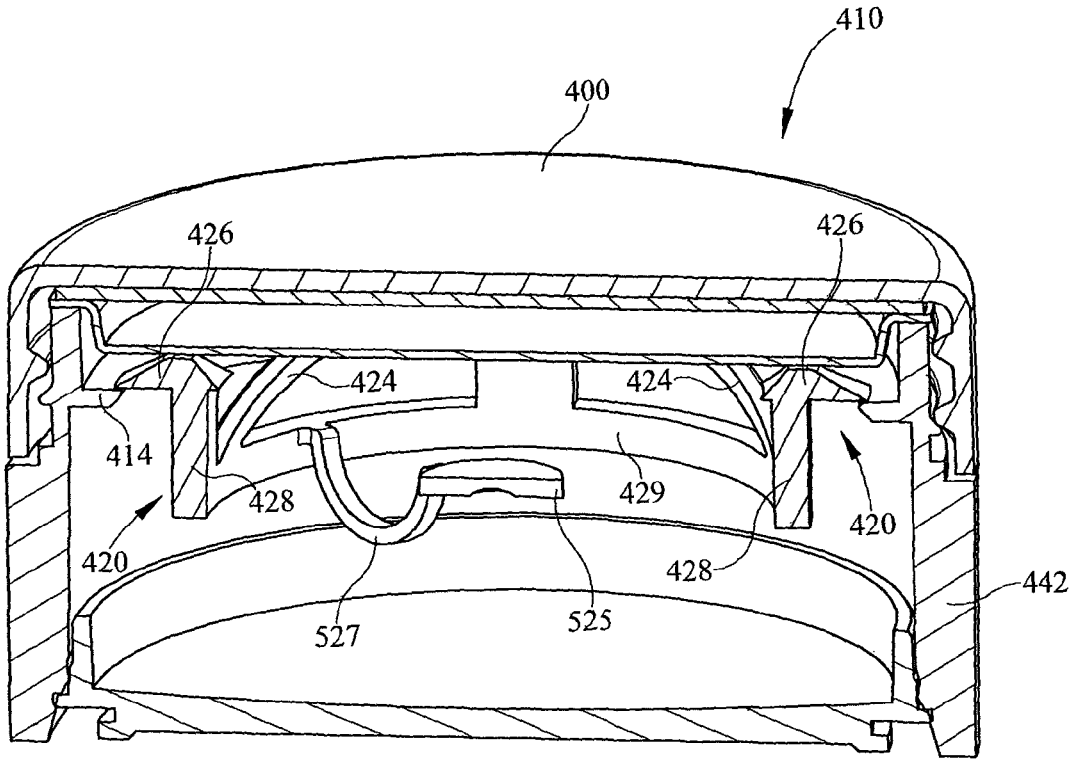
FIG. 8 is a sectional perspective view of a further alternative embodiment.

The embodiment of FIG. 8 depicts a short dispenser without an applicator. However alternate embodiments may utilize an applicator. For example, with reference to FIGS. 9 and 10, a dispenser 50 is depicted which includes an applicator 550 disposed within a top 540. Beneath the top is a portion of a container or enclosure 542 for product. This exemplary embodiment allows for threaded attachment of a further container wherein product 30 may be housed. In this manner, replacement enclosures may be sold and the user need only detach the empty portion and reattach the new portion. This is however one example and the enclosure 542 may be a unitary structure.

Figure 9:
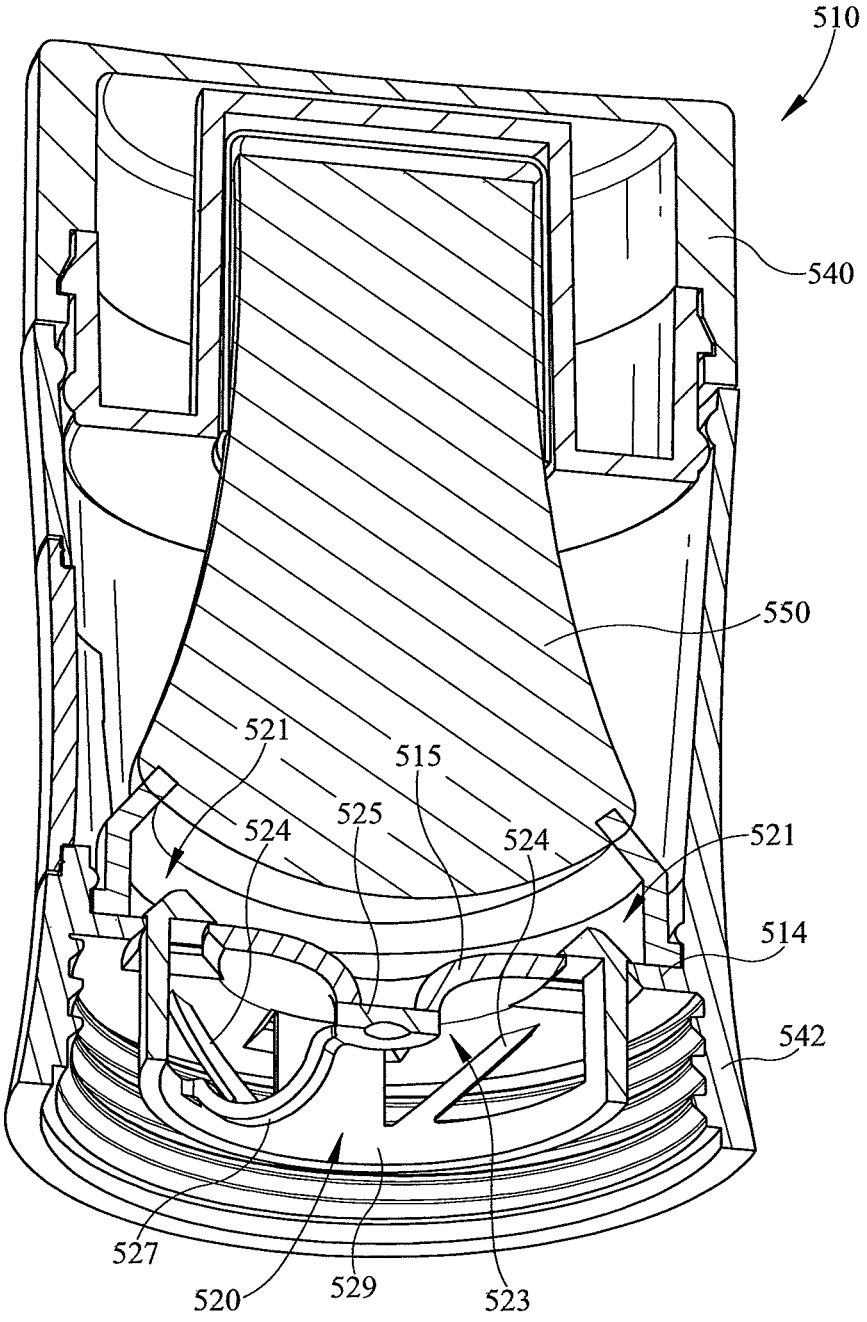
FIG. 9 is a sectional perspective view of an alternate embodiment of FIG. 8 having a closed valve.
Figure 10:
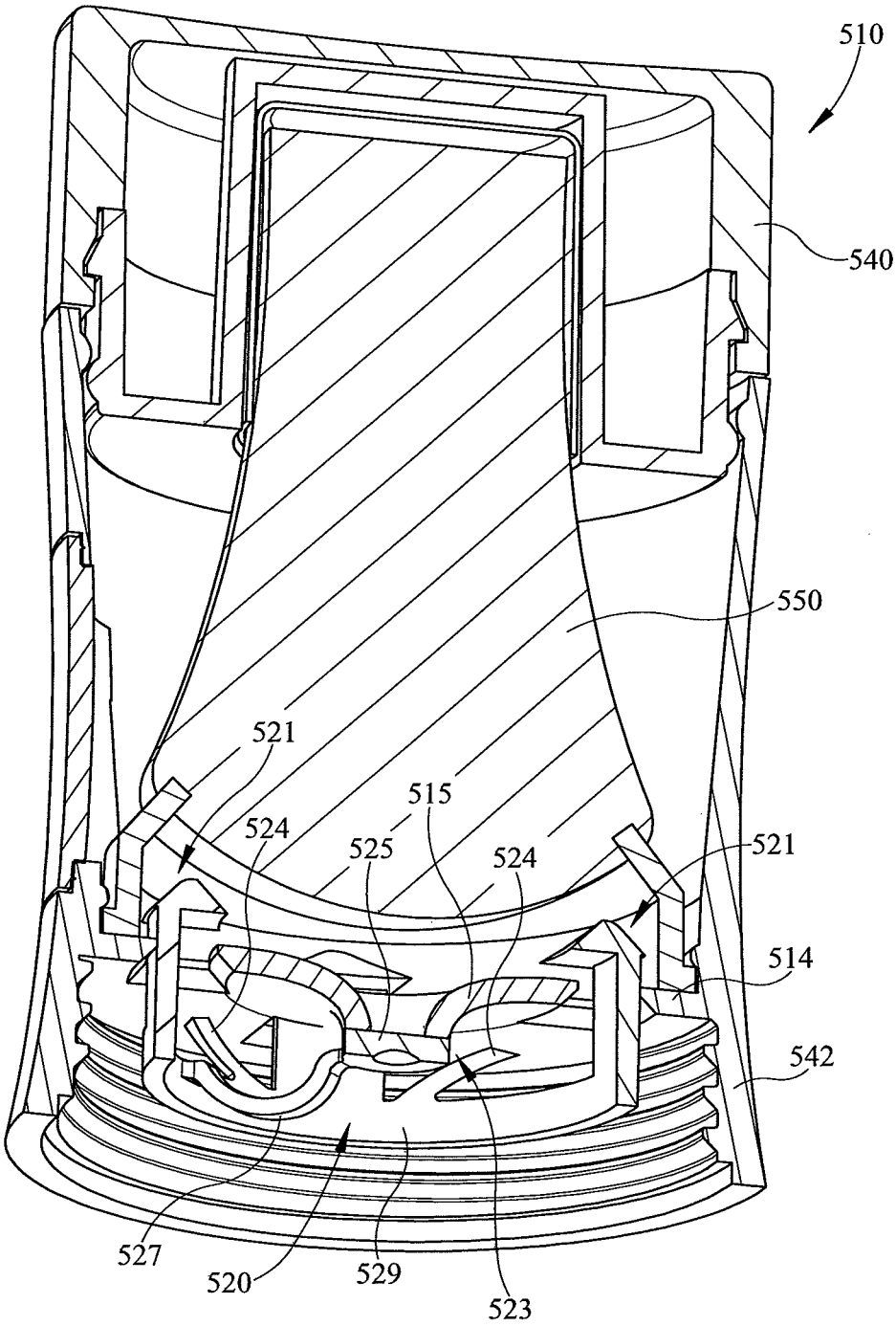
FIG. 10 is a sectional perspective view of the embodiment of FIG. 9 having an open valve.
Figure 11:
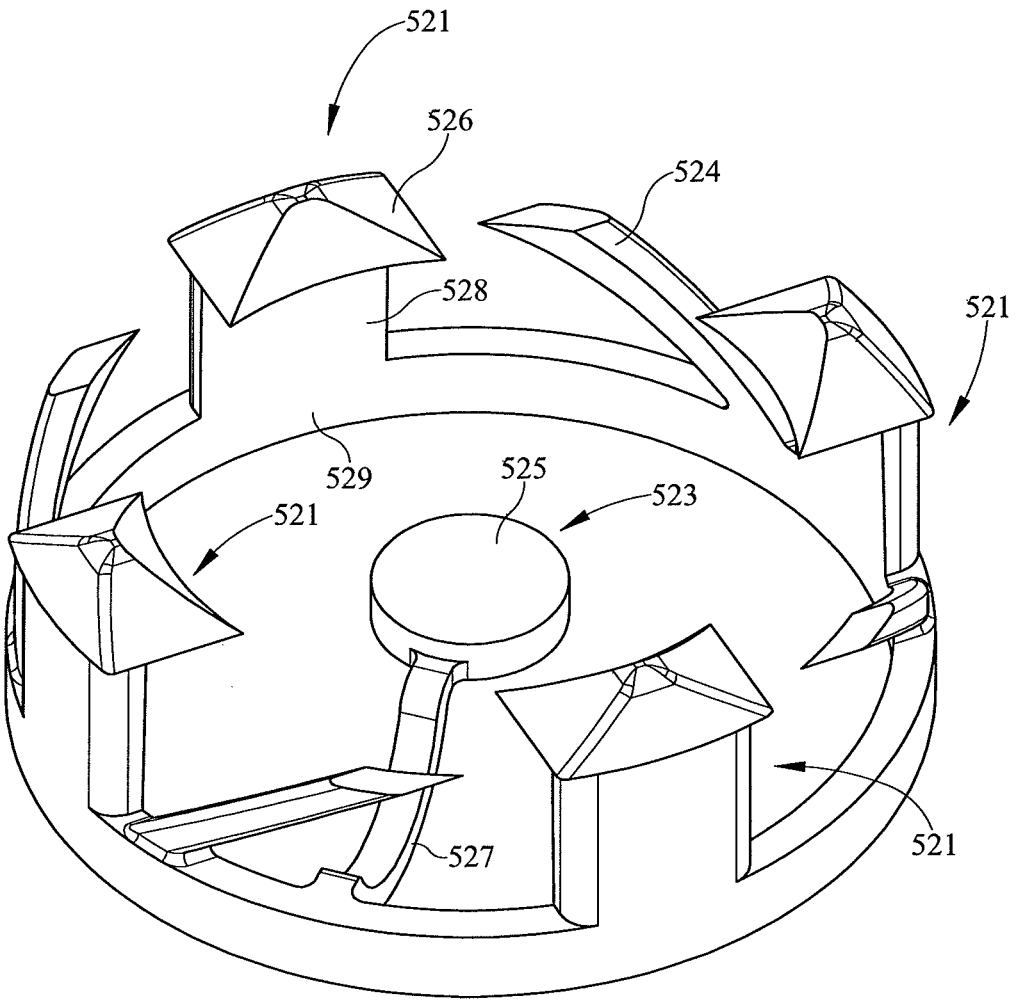
FIG. 11 is a perspective view of an exemplary view of the inertial valve of FIGS. 8-10.

The inertial valve 520 shown in FIGS. 9-11 in the lower enclosure 542 and passing through the valve plate 514, as described with respect to FIG. 8. The valve 520 is structurally equivalent to valve 420 of FIG. 8, the description of which is incorporated herein by reference. In this view however, the input valve 523 is also easily discernable. The cover plate 514 has a central depression 515 with an aperture therein to allow product collected in the depression to be moved toward the product container (not shown). An input spring arm 527 extends from the tensioner 529 to an inertial mass 525, in this example an input mass. This input mass 525 becomes unseated from the depression 515 when the dispenser 510 is accelerated in the opposite direction to open the output valves 521. Although the input valve 523 is shown centrally located, this is not a mandatory limitation. Similarly, while the output valves 521 are peripherally located, this also is not a mandatory limitation.

The Product Dispensing Enclosure with Inertial Valve allows for: metering capability to the enclosure based upon a defined behavior of the inertial valves wherein more taps move proportionally more product; unused product may be saved by moving it back into the product chamber; use of a natural motion to transfer powder. Tapping and shaking are two of the most widely used actions to move powders such as salt, sugar or coffee.

Although the embodiments disclosed above relate to powder dispensers, the Product Dispensing Enclosure with Inertial Valve is not limited to powder and may be used to dispense liquid product as well.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A product dispenser, comprising:

an enclosure having a valve support plate enclosing at least one sidewall;

a top removably connected to said at least one sidewall, said top disposed over said enclosure and spaced from said valve support plate;

said valve support plate having at least one output aperture;

an inertial valve supported from said valve support plate;

said inertial valve having a head sealingly engaging said at least one output aperture;

said head disengaging said at least one aperture during abrupt acceleration when said top is positioned over said enclosure and when said top is removed from said enclosure.

2. The product dispenser of claim 1, said inertial valve having a spring.

3. The product dispenser of claim 2, said spring extending from a tensioner.

4. The product dispenser of claim 1, said inertial valve being spring biased.

5. The product dispenser of claim 1, said inertial valve inhibiting free flow of undispensed powder.

6. The product dispenser of claim 1, said valve support plate extending across said enclosure.

7. The product dispenser of claim 1, said valve support plate being circular in shape.

8. The product dispenser of claim 1, said valve support plate being a non-circular geometric shape.

9. The product dispenser of claim 1, said valve support plate being flat.

10. The product dispenser of claim 1, said valve support plate having a low point and a high point.

11. The product dispenser of claim 1, said valve support plate being curvilinear.

12. The product dispenser of claim 1, said inertial valve having a head, a tensioner and a neck extending there between.

13. A product dispenser, comprising:

a top;

an enclosure including a cover plate, said enclosure connectable to said top;

a plurality of flow apertures in said cover plate;

an inertial valve engaging said flow apertures to selectively open upon application of acceleration;

said inertial valve being biased against said cover plate to a normally closed position and flexing to move to an open position regardless of whether said top is connected to or disconnected from said enclosure.

14. The product dispenser of claim 13, said inertial valve including an input valve and an output valve.

15. The product dispenser of claim 13, said cover plate having a depression.

16. A product dispenser, comprising:

an enclosure having a valve support plate enclosing at least one sidewall;

a top removably positioned over said enclosure;

said valve support plate having at least one output aperture;

an inertial valve having a spring extending to said valve support plate;

said inertial valve having a head sealingly engaging said at least one output aperture;

said head disengaging said at least one aperture independent of said top during abrupt acceleration when said top is positioned on said enclosure and when said top is removed from said enclosure.

17. The product dispenser of claim 16, said spring extending from a tensioner.

* * * * *